US007007986B2

(12) United States Patent
Lodwick, Jr.

(10) Patent No.: US 7,007,986 B2
(45) Date of Patent: Mar. 7, 2006

(54) ACCESS COVER FASTENING DEVICE

(75) Inventor: William Hadley Lodwick, Jr., Bristol, VA (US)

(73) Assignee: Kearney-National Inc., Abingdon, VA (US)

( * ) Notice: Subject to any disclaimer, the term of this patent is extended or adjusted under 35 U.S.C. 154(b) by 0 days.

(21) Appl. No.: 10/448,437

(22) Filed: May 30, 2003

(65) Prior Publication Data

US 2004/0239127 A1 Dec. 2, 2004

(51) Int. Cl.
*E05C 5/04* (2006.01)

(52) U.S. Cl. ..... 292/251; 292/256.71; 292/256.73; 292/291; 292/300; 292/DIG. 11; 292/DIG. 14; 174/38

(58) Field of Classification Search ..... 292/251, 292/256.71, 256.73, 291, 300, 301, DIG. 11, 292/DIG. 14, 212, 256.5, 256.75; 403/343, 403/362, 408.1; 220/325, 327; 49/381, 49/385; 16/293, 295; 174/38
See application file for complete search history.

(56) References Cited

U.S. PATENT DOCUMENTS 183,365 A * 10/1876 Birch ..... 292/301
184,399 A * 11/1876 Mann ..... 292/301
365,232 A * 6/1887 Bingham ..... 220/327
1,033,448 A * 7/1912 Mueller ..... 210/163
1,037,747 A * 9/1912 Elliott ..... 292/256.73
1,055,206 A * 3/1913 Miller ..... 292/251
1,446,364 A * 2/1923 Wheeler ..... 292/256.71
1,462,783 A * 7/1923 Barbarou ..... 220/259.2
1,571,574 A * 2/1926 Crossley ..... 70/159
1,609,772 A * 12/1926 Rank ..... 292/175
1,684,983 A * 9/1928 Clark ..... 292/304
1,767,226 A * 6/1930 Pearson ..... 220/3.8
1,927,780 A * 9/1933 Anderson ..... 292/251
1,943,482 A * 1/1934 Madro ..... 285/179.1
2,077,626 A * 4/1937 Hull ..... 292/281
2,099,918 A * 11/1937 Winter ..... 220/3.8
2,199,683 A * 5/1940 White ..... 220/3.8
2,272,178 A * 2/1942 McDowell et al. ..... 220/305
2,461,259 A * 2/1949 Ciarfello ..... 138/89
2,480,434 A * 8/1949 Askin ..... 249/169
2,952,488 A * 9/1960 Appleton ..... 292/256.73
2,987,909 A * 6/1961 Shlank ..... 70/168
3,018,127 A * 1/1962 Dobrosielski et al. ..... 292/251
3,313,599 A * 4/1967 Boon ..... 422/242
3,343,322 A * 9/1967 Lurkis et al. ..... 52/298
3,349,947 A * 10/1967 Zumwalt ..... 220/327
3,550,637 A * 12/1970 Briden ..... 138/92
3,755,977 A * 9/1973 Lewis ..... 52/98
4,099,754 A * 7/1978 Hoebing ..... 292/206
4,339,054 A * 7/1982 Kellogg ..... 220/295
4,914,258 A * 4/1990 Jackson ..... 174/45 R
5,391,837 A * 2/1995 Carey ..... 174/50
5,524,411 A * 6/1996 Crossman ..... 52/736.1
5,641,939 A * 6/1997 Tourigny ..... 174/45 R
5,791,701 A * 8/1998 Daoud ..... 292/129

(Continued)

*Primary Examiner*—Brian E. Glessner
*Assistant Examiner*—Carlos Lugo
(74) *Attorney, Agent, or Firm*—Jacobson Holman PLLC

(57) ABSTRACT

A hollow aluminum pole has access to its interior through a hand hole frame having an access aperture which can be blocked by a cover having a lower end pivotally attached to the hand hole frame by a pivot pin. The pivot pin is biased inwardly by a coil spring which permits outward movement of the cover to a position in which it can be rotated downwardly out of alignment with the access opening.

13 Claims, 7 Drawing Sheets

U.S. PATENT DOCUMENTS 6,089,396 A * 7/2000 Pozek ..... 220/251
6,204,446 B1 * 3/2001 Parduhn ..... 174/45 R
6,428,061 B1 * 8/2002 Daoud ..... 292/251
6,833,505 B1 * 12/2004 Macchietto ..... 174/66

* cited by examiner

ACCESS COVER FASTENING DEVICE

BACKGROUND OF THE INVENTION

The present invention is in the field of access openings provided with a selectively removable cover for effecting access to the interior of a hollow light pole or other similar housing. It should be noted that the following descriptive discussion for the sake of clarity and avoidance of confusion refers solely to "poles" as being the item with which the embodiments of the invention are associated; however, the invention is not limited to pole usage and can be employed on any one of a multitude of hollow housings requiring internal access. Light poles are frequently provided with hand hole access openings for permitting access to the interior chamber defined by the inside surface of the wall of the pole. A number of disadvantages and problems arise from the prior art structures. For example, many hand hole covers previously employed in the industry required the removal of two screws, one on each end of the cover, for enabling complete removal of the cover. Removal of the screws holding a cover in position on a hand hole can be time consuming due to the possibility of corrosion or stripping of the threads either in the hand hole housing or on the screws. Moreover, removal of both screws results in complete separation of the cover and screws from the pole so as to increase the possibility that the cover and/or screws will become disassociated from the pole and not be reconnected to the pole.

Many of the tamper resistant pole access devices employ special tools necessary for removing the access cover. Such devices consequently are more expensive to manufacture and require the additional expense of such special tools, Moreover, many of such devices still fail to prevent an unintentional loss of the cover. Thus, another problem with many of the prior known devices is that removal of the cover completely separates it from the access opening in the hand hole frame which results in potential exposure of the interior pole to the undesirable effects of inclement weather.

It is also necessary for access assembly covers to be made tamper and theft resistant for obvious reasons. Unfortunately, this desirable result has not been available with many of the prior art devices.

Other known prior art devices have been provided with a cover retention chain or cable attached to and extending between the hand hole frame and the cover with one such conventional prior art device being shown in FIG. 7. Such devices do not prevent opening of the cover but are frequently detrimental to providing complete access to the interior of the pole.

Another approach to dealing with the foregoing problems has involved the employment of fold out hinges joining the lower end of a cover to the lower end of the access opening in the pole. Such devices are complicated and expensive. Moreover, such devices are difficult to adjust and frequently require some alteration before they can be mounted in an aluminum pole. Also, the hinge assembly can intrude into the interior of the pole in such a way as to interfere with or foul the internal wiring in the pole. Moreover, the opening of such devices results in their being in an awkward position frequently making it difficult to fully access the interior of the pole. Therefore, it is the primary object of this invention to provide an access opening cover assembly that is easy to operate, reliable and economical.

BRIEF SUMMARY OF THE INVENTION

Achievement of the foregoing objects is enabled by the disclosed embodiments in which an access opening is provided with a cover that is pivotally supported by a pin in the lower portion of the cover for pivotal movement and outward movement to position the cover out of alignment with the access opening while retaining the cover connected to a supporting hand hole frame. In all embodiments the supporting pin is spring urged inwardly to retain the lower portion of the cover in an access opening covering position while permitting manual outward movement for effecting opening of the cover.

DETAILED DESCRIPTION OF THE INVENTION

Figure 1:
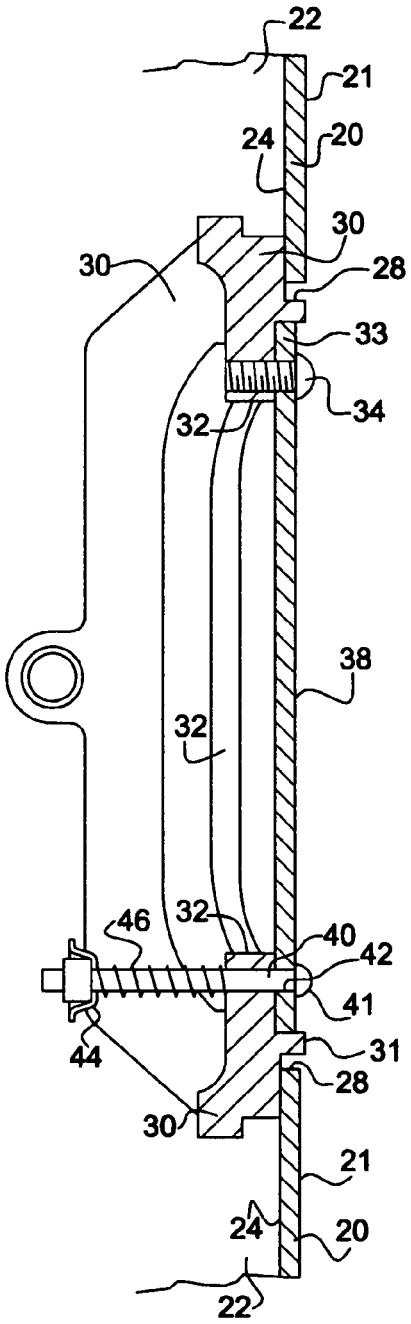
FIG. 1 is a bisecting sectional view of a first or slotted cup washer embodiment of the invention as employed in an aluminum light pole.
Figure 8:
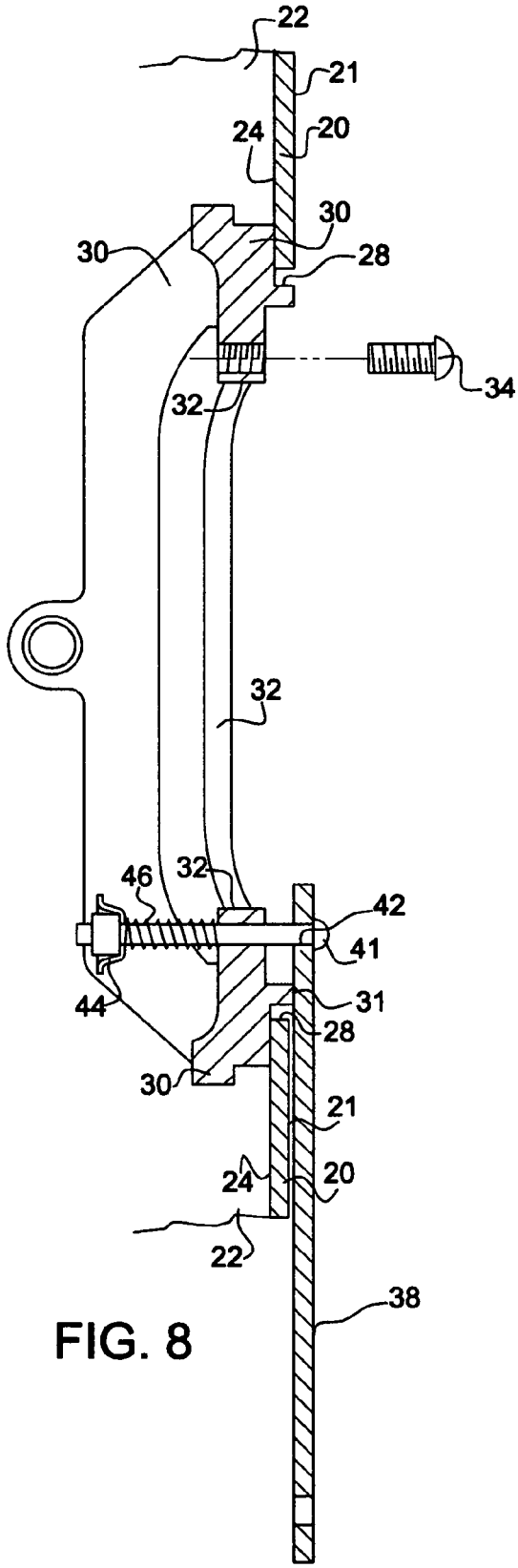
FIG. 8 is a sectional view similar to FIG. 1 illustrating the position of the cover in an open position permitting access to the interior of the pole.
Figure 2:
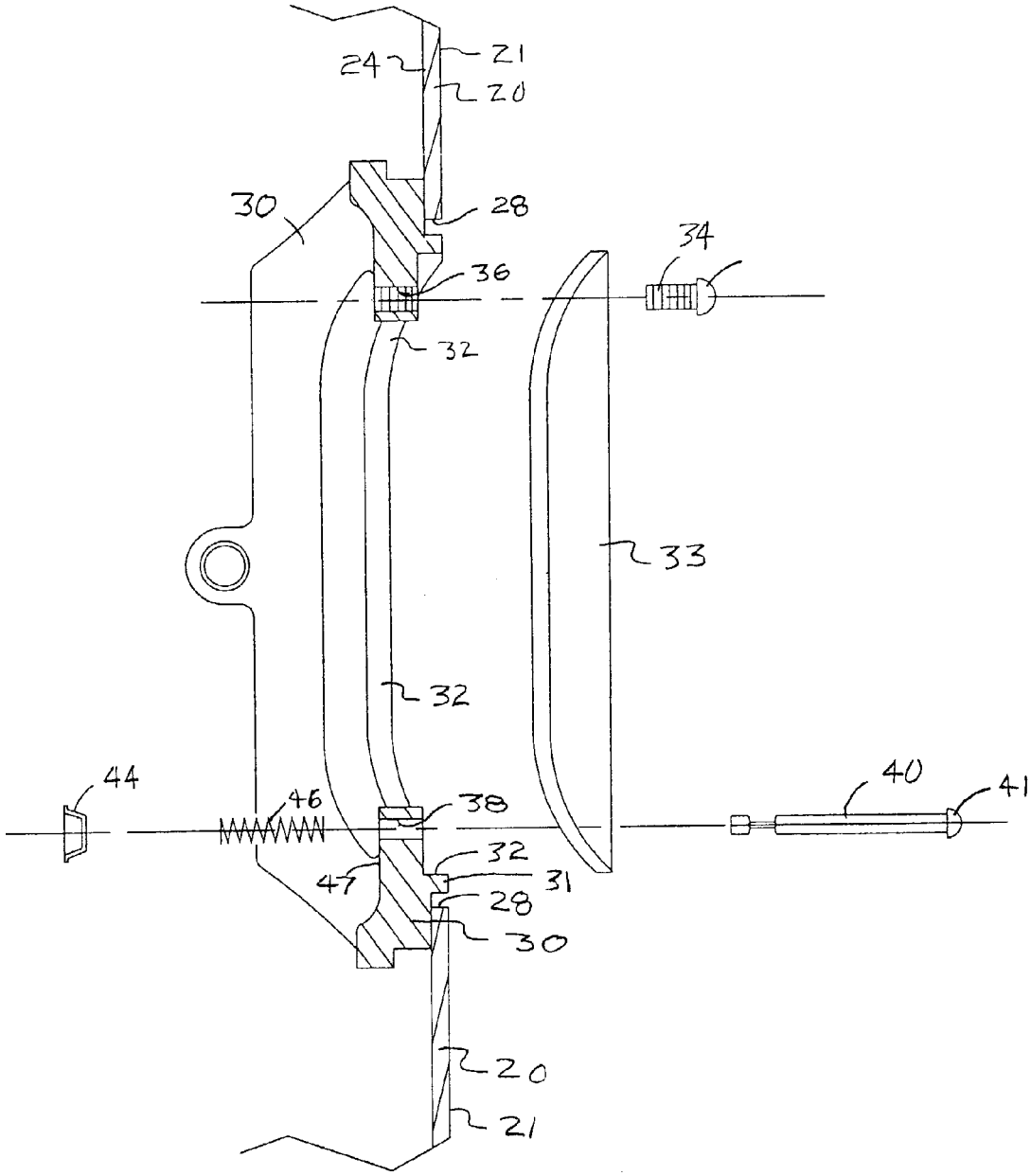
FIG. 2 is an exploded view of the embodiment of FIG. 1.
Figure 3:
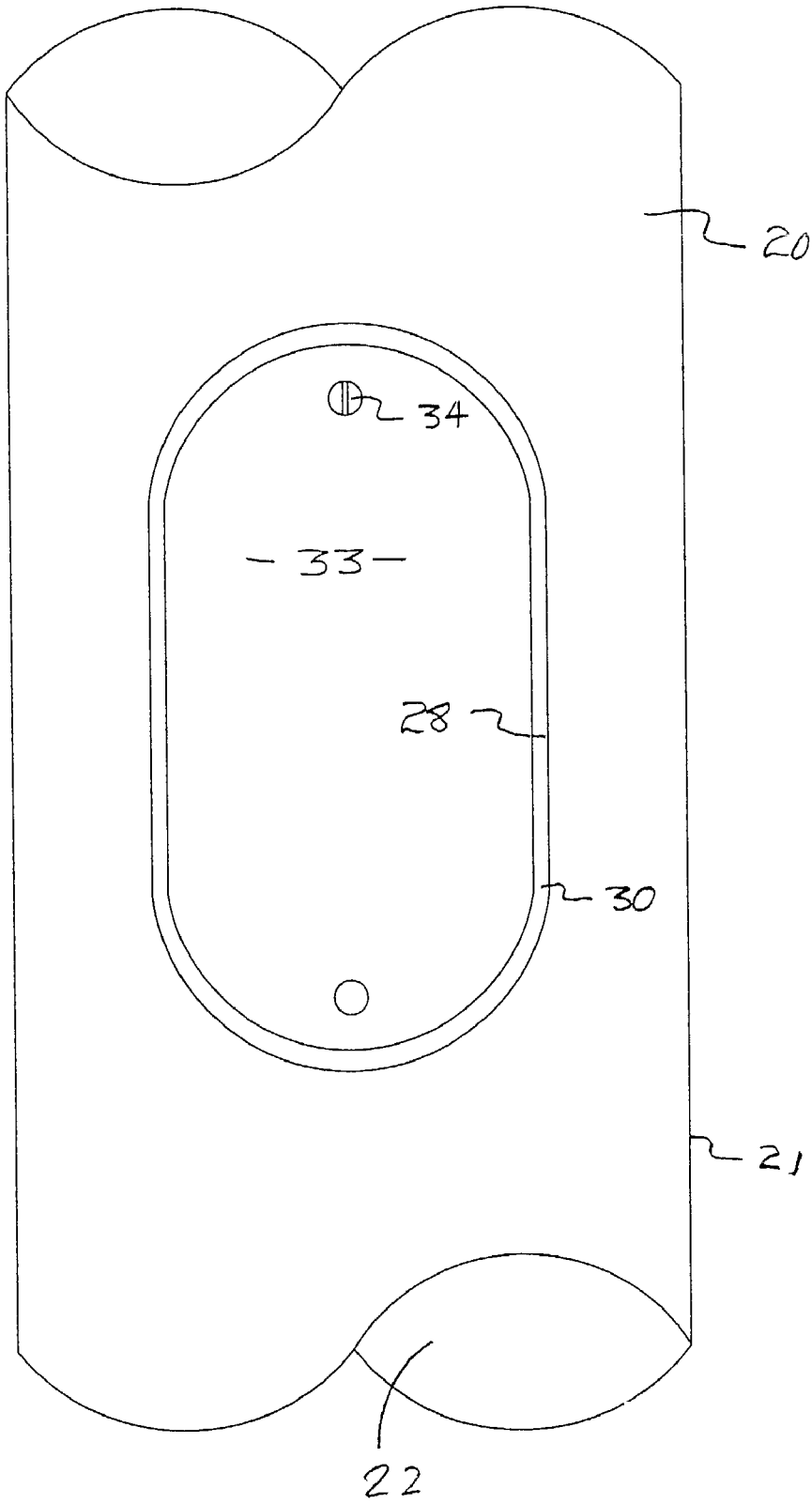
FIG. 3 is a front elevation view of a typical aluminum light pole of the type in which either embodiment of the invention is mounted.

Attention is initially invited to FIGS. 1 and 2 of the drawings which illustrate a first embodiment of the invention as provided in a hollow tapered aluminum light pole 20. Pole 20 has an outer surface 21 and an inner chamber 22, which is defined by an inner surface 24 of the pole. Pole 20 is provided with an elongated access opening defined by closed surface 28 extending through the wall of the pole 20 between an outer surface 21 and an inner surface 24 of the pole. A hand hole frame 30 formed of cast aluminum has a flange 31 with a closed surface 32 defining a port opening coaxial with the opening defined by surface 28 of the pole. The port defining surface 32 is of sufficient size to permit access to the interior of the pole for repairs or other purposes.

A metal cover 33 is dimensioned to fit within the confines of flange 31 and outwardly of the port defining surface 32 as best shown in FIG. 1. A first threaded connector screw 34 extends through a bore in cover 33 and is threaded into a threaded bore 36 (FIG. 2) in the upper portion of hand hole frame 30 as shown. The head of screw 34 is slotted in a conventional manner as shown; however, other drive surface configurations such as octagonal or hexagonal heads usable with socket drives could also be used.

Figure 4:
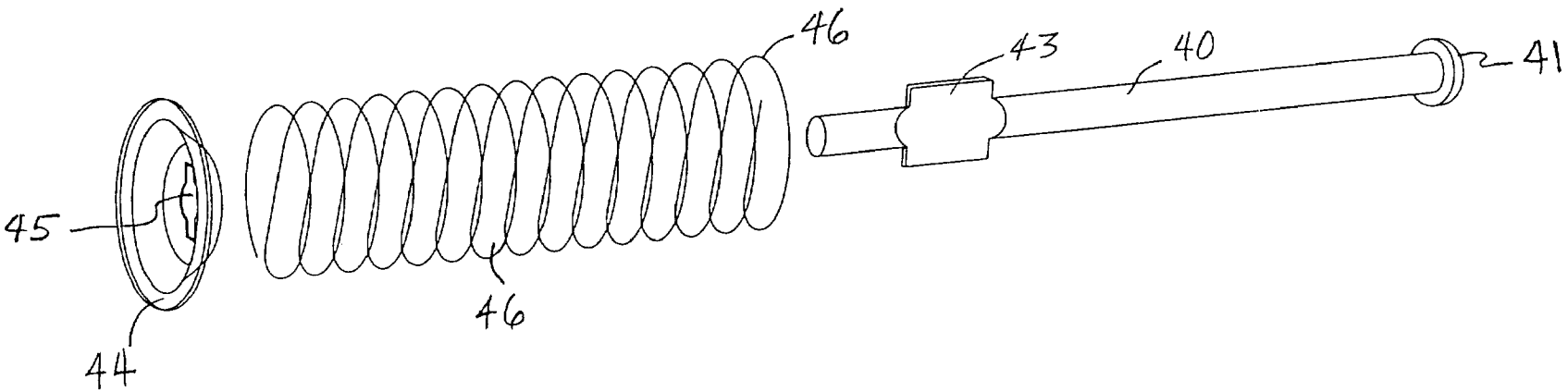
FIG. 4 is an exploded perspective view of the slotted cup washer and pin assembly employed in the FIG. 1 embodiment.

A smooth non-threaded bore 38 is provided in the lower portion of hand hole frame 30 for receiving a non-threaded tabbed pin 40 having a pin head 41 at an outer end and a washer retainer tab 43 fixedly attached near an opposite end as shown in FIG. 4. Pin 40 extends through a smooth non-threaded bore 42 in cover 33 as shown in FIG. 1. A slotted cup washer 44 is retained on the outer end of the non-threaded tabbed pin 40 by tab 43. Slotted cup washer 44 has a slot 45 (FIG. 4) through which tab 43 is inserted following which a washer 44 is rotated so that slot 45 is not aligned to tab 43 so that washer 44 is retained on pin 40 by tab 43. Washer 44 is engaged by the inner end of a compression spring 46 which has an upper opposite end engaging an inwardly facing surface 47 of the hand hole frame 30 as best shown in FIG. 1. Compression spring 46 consequently exerts force against the slotted cup washer 44, which consequently urges tab 43 and non-threaded tabbed pin 40 toward the inner chamber 22 of pole 20. The inward movement of the pin is limited by engagement of pin head 41 with cover 33 which in turn engages the front face of hand hole 30 in an obvious manner. Therefore, first connector screw 34 and non-threaded tabbed pin 40 comprise first and second connectors for maintaining the cover 33 in the closed position shown in FIG. 1.

Access to the interior of light pole 20 is initiated by first removing the threaded first connector screw 34 following which the cover can be moved outwardly to compress compression spring 46. Such outward movement permits subsequent rotation of the cover 33 about non-threaded tabbed pin 40 so that the cover can be rotated to be substantially fully positioned below the access opening defined by closed surface 32 of the hand hole frame 30. The force of spring 46 will hold the cover in the aforementioned position for as long as necessary because of contact of the cover with the outer surface of the hand hole resultant from the force of the spring.

The embodiment shown in FIGS. 1 and 2 consequently requires removal of only connector screw 34 following which the lower end of the cover can be moved outwardly to a convenient position permitting rotation of the cover about pin 40 to effect full access to the interior of the pole. The cover can subsequently be rotated back to the position in alignment with the access port 32 so that the pin 40 urges the cover in position and holds it there while the first connector screw 34 is reinserted and threaded into threaded bore 36.

Figure 5:
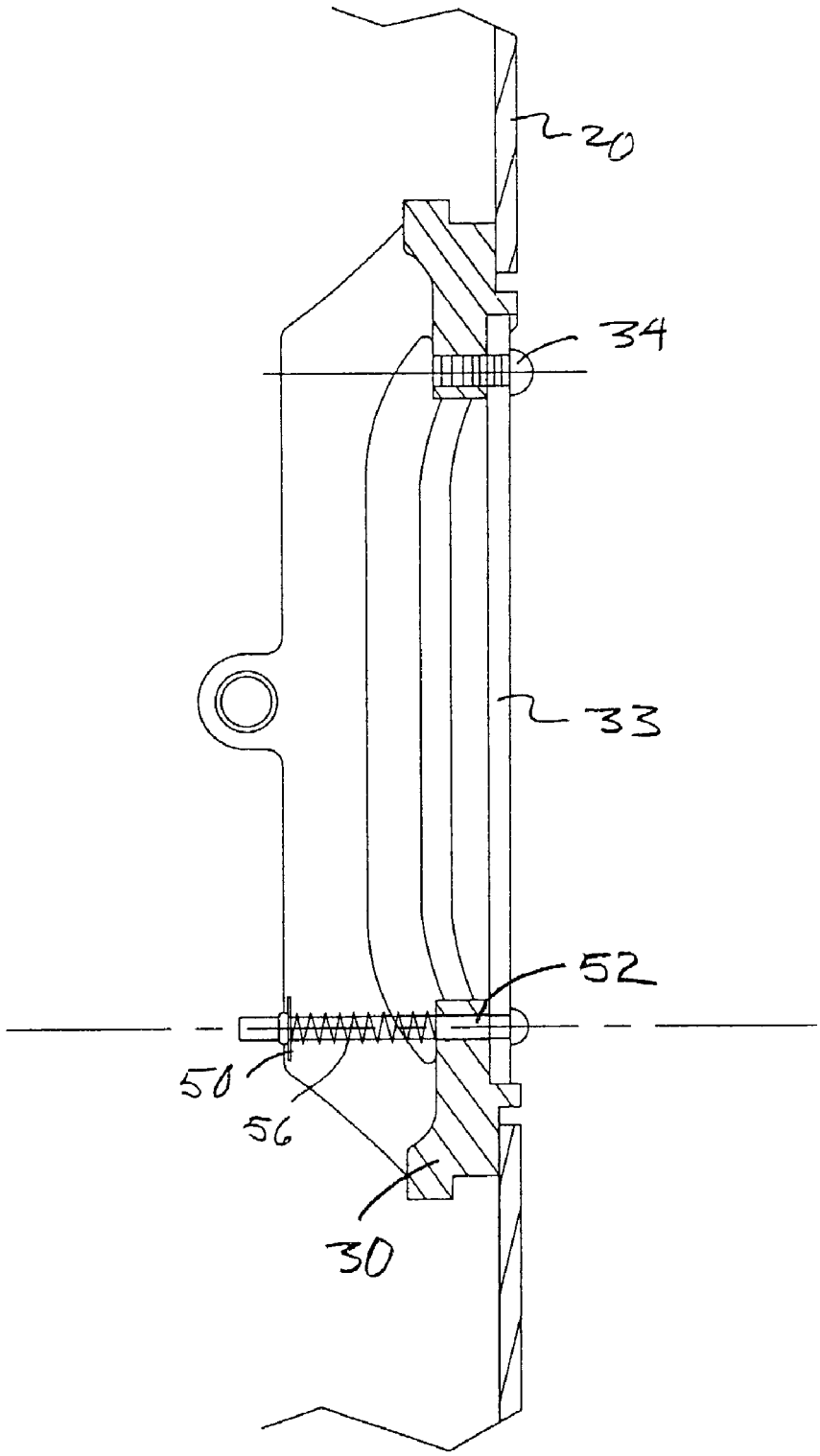
FIG. 5 is a bisecting sectional view of a second or flat washer embodiment of the invention as employed in an aluminum light pole.
Figure 6:
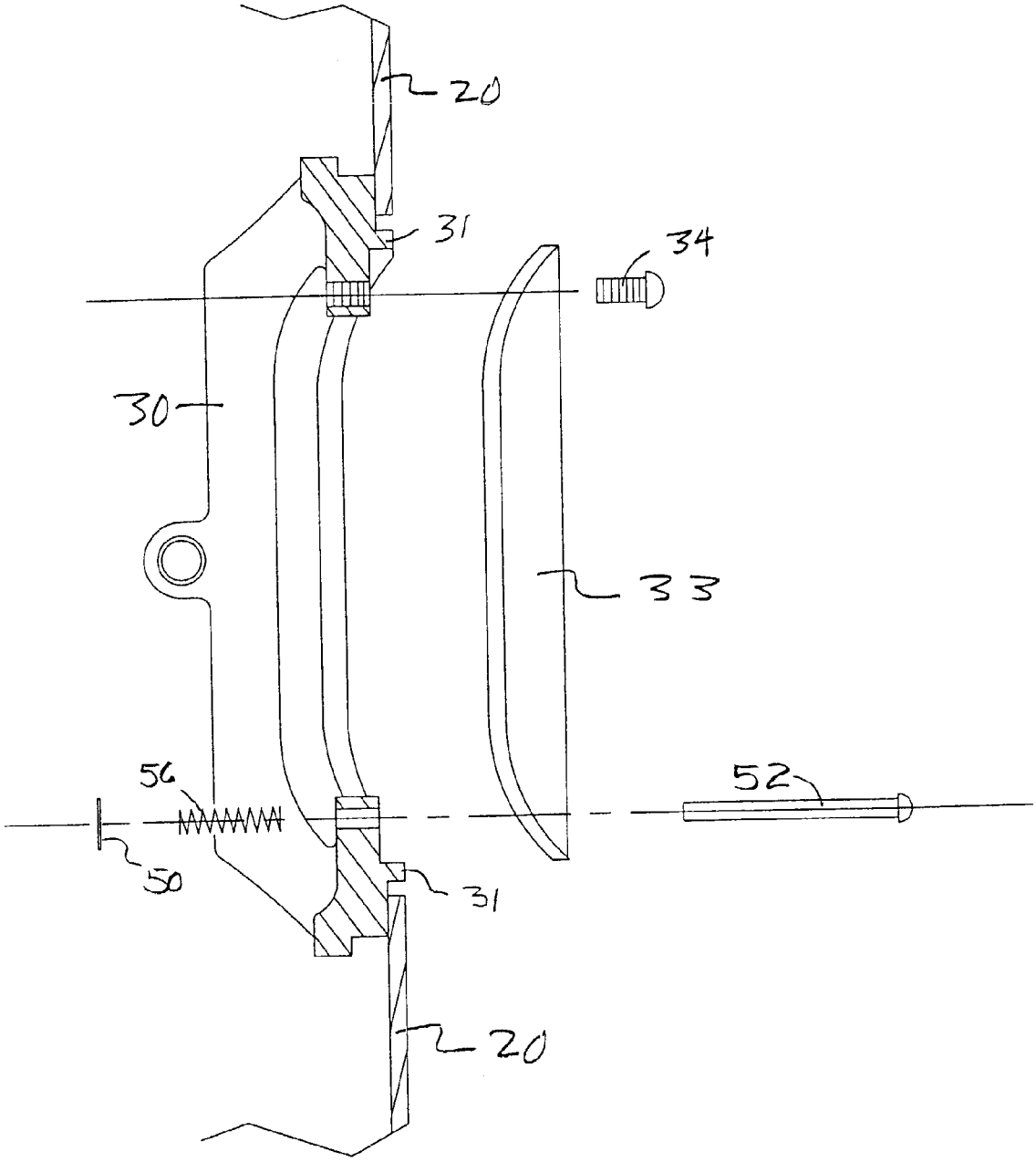
FIG. 6 is an exploded sectional view of the embodiment of FIG. 5.
Figure 7:
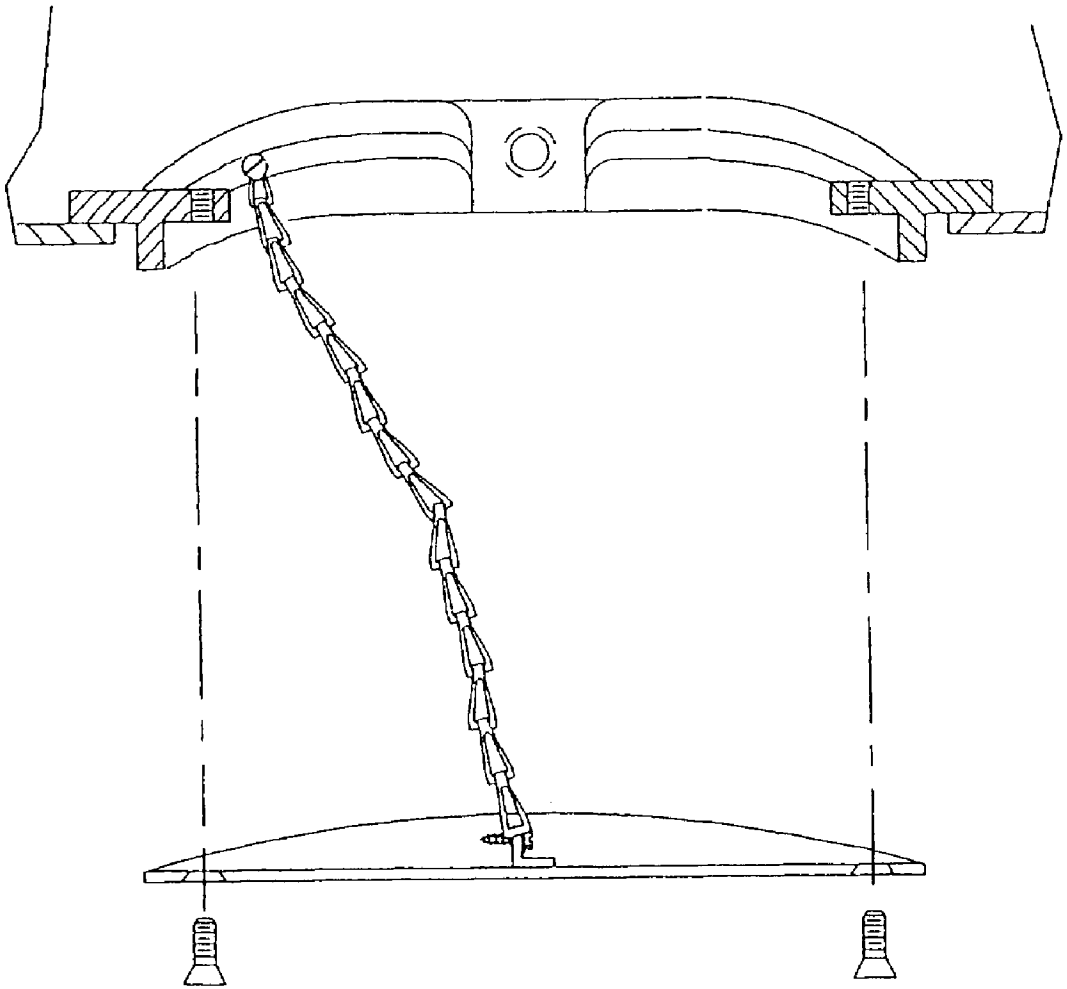
FIG. 7 (PRIOR ART)
FIG. 7 is an exploded sectional view of a prior art assembly.

FIGS. 5 and 6 illustrate a second embodiment of the invention which is essentially identical to the first embodiment of FIGS. 1 and 2 with exception of the fact that a flat washer 50 is fixedly attached by welding or forming to the pin to lock the washer in position on the outer end of a standard smooth-surface pin 52 having a head 54 as shown. A compression spring 56 is fitted between flat washer 50 and hand hole frame 30 as shown in FIG. 5 with the device operating in essentially the same manner as the first embodiment. However, the flat washer 50 provides greater resistance to removal or theft of the cover in that it is more resistant to removal than the slotted cup washer of the first embodiment. In an optional arrangement a cotter pin or the like can be provided through an opening in the pin inwardly of the washer to retain the washer on the pin.

Numerous modification of the disclosed embodiments will undoubtedly occur to those of skill in the art without departing from the spirit and scope of the invention as defined by the appended claims.

What is claimed is:

1. A selectively openable closure assembly including a handhold frame mounted in a wall of a hollow housing having an inner chamber and an inner surface and an outer surface between which an access opening extends to permit access to the inner chamber from a location external to the hollow housing, a cover positionable over the access opening for closing the access opening and being movable from the closed position to an open position spaced from the access opening so as to permit access to the inner chamber, a first connector removably mounted on the handhold frame and engaging a first portion of the cover and a portion of the handhold frame for holding the first portion of the cover in a fixed position relative to the frame, a second connector spaced from the first connector and engaging the cover and the handhold frame to cooperate with the first connector when the first connector is mounted on the handhold frame for maintaining the cover in a closed position over the access opening, wherein disconnection of the first connector from the frame permits limited movement of the cover outwardly of the access opening followed by pivotal movement of the cover about the second connector out of alignment with the access opening while retaining a tethered connection of the cover to the frame so as to prevent the unauthorized removal of the cover while permitting unrestricted access through the access opening, and wherein the second connector is an unthreaded pin mounted for axial movement in an aperture in the handhold frame, and additionally including a spring providing a biasing force urging the unthreaded pin inwardly of the frame and further including a force applying surface on the unthreaded pin engaging the cover so that the force provided by the spring tends to urge the cover inwardly toward the handhold frame.

2. A selectively operable closure assembly as recited in claim 1, additionally including a washer attached to an inner end of the unthreaded pin which is spaced inwardly of the handhold frame and wherein the spring is a coil spring extending in compressed condition between an inner surface of the handhold frame and the washer so as to effect application of an inward force on the cover by the force supplying surface of the unthreaded pin.

3. A selectively operable closure assembly as recited in claim 2, wherein the force supplying surface of the unthreaded pin is an inwardly facing radial surface of a head on the unthreaded pin.

4. A selectively operable closure assembly as recited in claim 3, wherein the first connector is a threaded screw threadably attached to the handhold frame.

5. A selectively operable closure assembly as recited in claim 4, wherein the washer is fixedly secured to the inner end of the unthreaded screw.

6. A selectively operable closure assembly as recited in claim 4, wherein the washer is a slotted cup washer.

7. An access opening assembly comprising a frame having an inner side and an outer side, an access opening extending between the inner side and the outer side of the frame, an axially moveable linear pin having an access and mounted in the frame for movement toward and away from the outer side of the frame between an inward position and an outer position, a spring urging the pin inwardly towards its inner position, a cover pivotally mounted on the axially moveable linear pin for rotation about the access of the axially moveable linear pin between a first position overlying and blocking the access opening and a second position laterally spaced from the access opening and a flange on the frame precluding rotation of the cover when the cover is in its first position.

8. A selectively openable closure assembly including a frame mounted in a wall of a hollow pole having an inner surface defining an inner chamber and an outer surface with an access opening extending through the handhold frame to permit access to the inner chamber from a location external to the hollow pole, a cover positionable over the access opening for closing the access opening, the cover being movable from the closed position to an open position spaced from the access opening so as to permit access to the inner chamber, a first connector removably mounted on the handhold frame and engaging a first portion of the cover and a portion of the handhold frame for holding the first portion of the cover in a fixed position relative to the frame, a second connector spaced from the first connector and engaging the cover and the handhold frame to cooperate with the first connector when the first connector is mounted on the handhold frame for maintaining the cover in a closed position over the access opening, wherein disconnection of the first connector from the frame permits limited movement of the cover outwardly of the access opening followed by pivotal movement of the cover about the second connector out of alignment with the access opening while retaining a tethered connection of the cover to the frame so as to prevent the unauthorized removal of the cover while permitting unrestricted access through the access opening, and wherein the second connector is an unthreaded pin mounted for axial movement in an aperture in the handhold frame, and additionally including a spring providing a biasing force urging the unthreaded pin inwardly of the frame and further including a force applying surface on the unthreaded pin engaging the cover so that the force provided by the spring tends to urge the cover inwardly toward the handhold frame.

9. A selectively operable closure assembly as recited in claim 8, additionally including a washer attached to an inner end of the unthreaded pin which is spaced inwardly of the handhold frame and wherein the spring is a coil spring extending in compressed condition between an inner surface of the handhold frame and the washer so as to effect application of an inward force on the cover by the force supplying surface of the unthreaded pin.

10. A selectively operable closure assembly as recited in claim 9, wherein the force supplying surface of the unthreaded pin is an inwardly facing radial surface of a head on the unthreaded pin.

11. A selectively operable closure assembly as recited in claim 10, wherein the first connector is a threaded screw threadably attached to the handhold frame, the washer is fixedly secured to the inner end of the unthreaded screw and the washer is a slotted cup washer.

12. An access opening assembly comprising a frame having an inner side and an outer side, an access opening extending between the inner side and the outer side of the frame, an axially moveable linear pin having an axis and mounted in the frame for linear movement between an inward position and an outer position relative to the frame, a spring urging the pin inwardly toward its inward position, a cover pivotally mounted on the axially moveable linear pin for rotation about the axis of the axially moveable linear pin when the pin is in its outer position between a first position overlying and blocking the access opening and a second position laterally spaced from the access opening and a flange on the frame precluding rotation of the cover when the cover is in its first position.

13. An access opening assembly as recited in claim 12, wherein the cover has an outer periphery and the flange on the frame surrounds and faces the periphery of the cover.

* * * * *